United States Patent [19]

Sato et al.

[11] 4,037,055

[45] July 19, 1977

[54] STEREOPHONIC DEMODULATOR APPARATUS

[75] Inventors: Teruo Sato, Yamato; Hideo Nakamura, Komae, both of Japan

[73] Assignee: Sony Corporation, Tokyo, Japan

[21] Appl. No.: 641,026

[22] Filed: Dec. 15, 1975

[30] Foreign Application Priority Data

Dec. 16, 1974 Japan ..... 49-144211

[51] Int. Cl.[2] ..... H04H 5/00

[52] U.S. Cl. ..... 179/15 BT

[58] Field of Search ..... 179/15 BT; 325/36, 65, 325/483

[56] References Cited

U.S. PATENT DOCUMENTS

| | | | |
|---|---|---|---|
| 3,584,154 | 6/1971 | McShan | 179/15 BT |
| 3,708,623 | 1/1973 | Dorren | 179/15 BT |
| 3,881,063 | 4/1975 | Mawake et al. | 179/15 BT |
| 3,902,018 | 8/1975 | Fockens | 179/15 BT |
| 3,934,092 | 1/1976 | Csicsatka | 179/15 BT |

*Primary Examiner*—Douglas W. Olms
*Attorney, Agent, or Firm*—Lewis H. Eslinger; Alvin Sinderbrand

[57] ABSTRACT

Stereophonic demodulator system for demodulating a stereophonic composite signal that includes a subcarrier frequency of at least 38 KHz, the apparatus including: a circuit for producing a 38 KHz switching signal, a circuit for producing a 114 KHz switching signal, a circuit to which the stereophonic composite signal and the 38 KHz switching signal are supplied to obtain a first demodulated signal, a circuit to which the stereophonic composite signal and the 114 KHz switching signal are supplied to obtain a second demodulated signal, and a circuit for mixing the first and second demodulated signals to produce the desired stereophonic signal free of any accompanying useless signal.

7 Claims, 8 Drawing Figures

STEREOPHONIC DEMODULATOR APPARATUS

BACKGROUND OF THE INVENTION

1. Field of the Invention

The present invention relates generally to a stereophonic demodulation system and particularly to a novel stereophonic demodulation system for demodulating a stereophonic signal free of any accompanying useless signal.

2. Description of the Prior Art

In prior art stereophonic demodulator apparatus, when a stereophonic composite signal of the type used in frequency modulation (FM) four-channel broadcasting is demodulated, a switching signal having a frequency of $f_1$, for example, 38 KHz is utilized. This switching signal contains a third harmonic component having a frequency of 114 KHz that causes various kinds of characteristic deterioration of the desired signal. Mathematically, the stereophonic composite signal F(*t*) used in four-channel broadcasting can be expressed by equation (1), as follows:

$$F(t) = a + b \sin \omega t + c \cos \omega t + d \sin 2\omega t + p \sin (\omega/2)t \quad (1)$$

where:

$\omega = 2\pi f_1$, $f_1 = 38$ KHz, $a = L_F + L_R + R_F + R_R$, $b = L_F + L_R - R_F - R_R$, $c = L_F - L_R + R_F - R_R$, $d = L_F - L_R - R_F + R_R$, $L_F$ is the amplitude of the left-front signal, $L_R$ is the amplitude of the left-rear audio signal, $R_F$ is the amplitude of the right-front audio signal, $R_R$ is the amplitude of the right-rear audio signal, and $p \sin (\omega/2)t$ represents a pilot signal.

The signal components of the stereophonic composite signal F(*t*), that is, the main signal *a*, the first sub-channel signal $b \sin \omega t$, the second sub-channel signal $c \cos\omega t$, and the third sub-channel signal $d \sin 2\omega t$, occupy different parts of the frequency spectrum. So-called triangular noise signals D, E and F in frequency bands corresponding to parts of the frequency spectrum occupied by the information signals are detected by an FM detector that is supposed to demodulate only the stereophonic signal. In addition to these triangular noise signals, there is another triangular noise signal G at a higher frequency band: the third harmonic component band of the 38 KHz carrier (114 ± 15 KHz). The amplitude of this triangular noise G is very high. In addition, a harmonic component of a stereophonic composite signal having a frequency less than about 65 KHz is included in the third harmonic component band of the demodulated signal, so that the phenomena of deterioration in signal-to-noise ratio (S/N), distortion factor, adjacent channel interference eliminating characteristics, and the like are produced within the audio frequency range. In order to avoid these undesirable effects, the useless signal component in the third harmonic band of 114 KHz may be removed by a low pass filter or band pass filter. However, these filters may have a bad effect on the third sub-carrier signal $d \sin 2\omega t$ having a carrier frequency of 76 KHz contained in the stereophonic composite signal F(*t*). The phase characteristics of the third sub-channel signal $d \sin 2\omega t$ are likely to be deteriorated and thus cause deterioration of separation characteristics. As a result, it is difficult to improve the deterioration in the S/N ratio, the distortion factor, adjacent channel interference eliminating characteristics, and the like, which are caused by the effect of third harmonic components of a demodulated signal.

Further, it is noticed that when a normal two-channel stereophonic composite signal is demodulated, if an adjacent broadcasting signal exists near the frequency to be received, the demodulated audio frequency band is badly affected by the third harmonics of 38 KHz.

SUMMARY OF THE INVENTION

It is an object of this invention to provide a stereophonic demodulator system and apparatus for producing an audio signal having low distortion factor and good S/N.

According to this invention a stereophonic demodulator system is provided that includes a first switching signal necessary for demodulating a stereophonic composite signal and a second switching signal having a fundamental frequency which is an integral multiple more than two of the frequency of the first switching signal. The composite signal is demodulated by the first and second switching signals thereby to produce first and second demodulated output signals, and these first and second demodulated output signals are added together to eliminate useless signals.

The invention will be described more fully hereinafter in connection with the accompanying drawings.

DESCRIPTION OF THE PREFERRED EMBODIMENTS

Figure 1A:
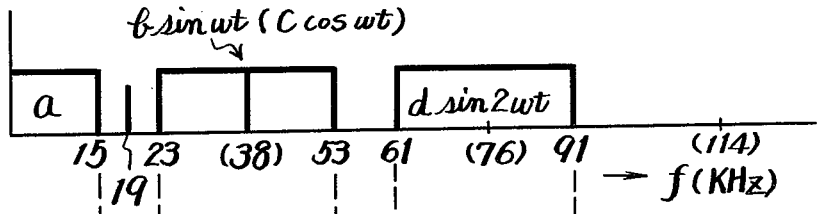
FIG. 1A is a graphical representation of a frequency spectrum of an FM four-channel stereophonic signal.
Figure 1B:
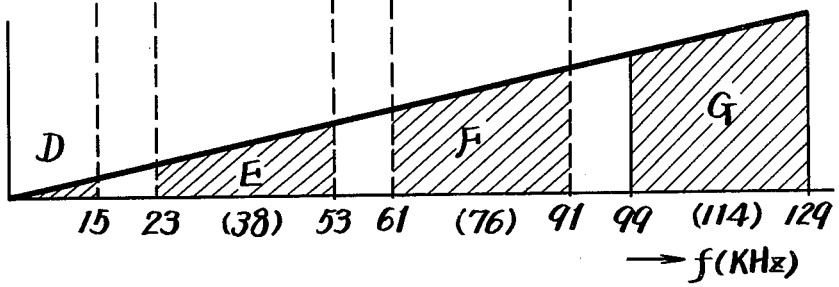
FIG. 1B is a graph of frequency versus noise characteristics corresponding to the frequency spectrum of the FM four-channel stereophonic signal shown in FIG. 1A.
Figure 3A:
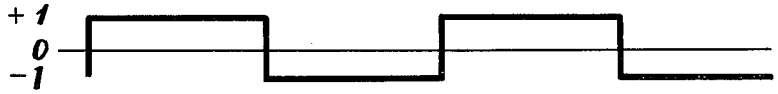
FIGS. 3A to 3E are graphical representations of signal waveforms used for explaining this invention.
Figure 3B:
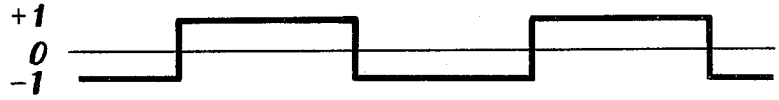
Figure 3C:
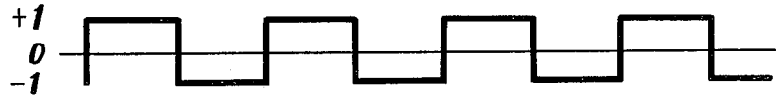
Figure 3D:
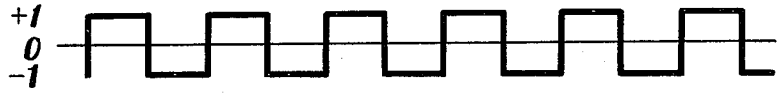
Figure 3E:
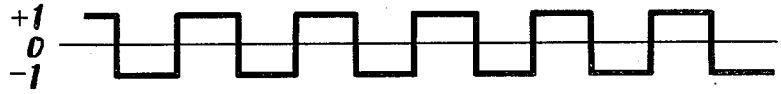
Figure 2:
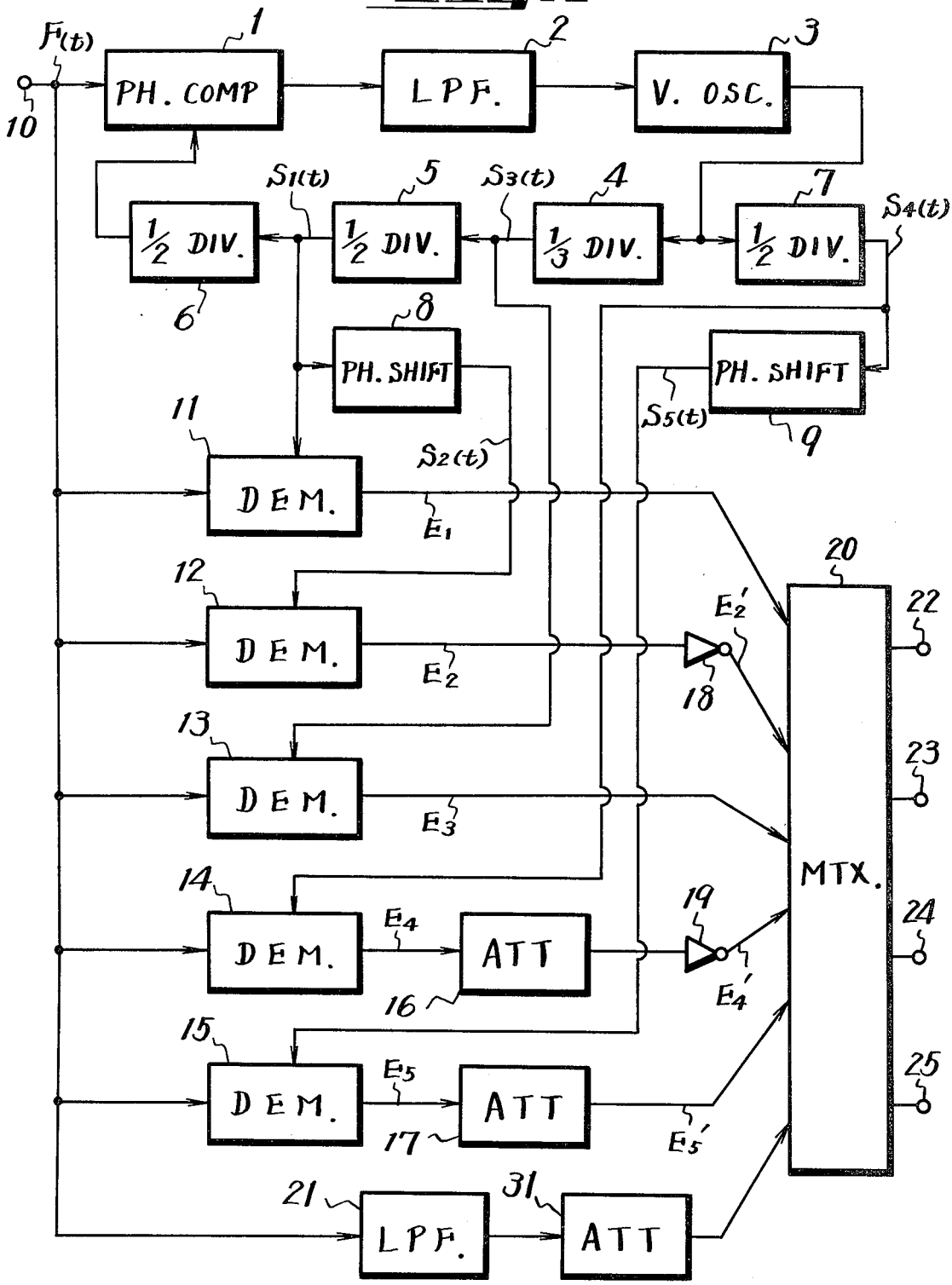
FIG. 2 is a block diagram of an FM stereophonic demodulator apparatus according to the invention.

The circuit in FIG. 2 includes a phase comparator 1, a low pass filter 2, and a variable frequency oscillator 3 connected to form a phase locked loop circuit. The loop circuit also includes three frequency dividers 4, 5, and 6 connected in that order between the output of the oscillator 3 and one input terminal of the phase comparator 1. Another frequency divider 7 is connected to the output of the oscillator 3, and two phase shifters 8 and 9 are connected, respectively, to output terminals of the frequency dividers 5 and 7. The FM four-channel broadcasting stereophonic composite signal F(*t*) defined by the equation (1) is connected to an input terminal 10 of the phase locked loop circuit and the phase comparator 1. Accordingly, the phase comparator 1 is supplied with the pilot signal component $p \sin (\omega/2)t$ contained in the stereophonic composite signal F(*t*).

The frequency divider 4 divides the frequency of the output signal of the variable frequency oscillator 3 by 3, the frequency divider 5 further divides the frequency by 2, and the frequency divider 6 still further divides the frequency by 2 to produce a signal of predetermined frequency to be supplied to the phase comparator 1. The frequency of the output signal of the variable frequency oscillator 3 is separately divided by 2 in the frequency divider 7. The output signal of the frequency divider 5 is defined as a switching carrier $S_1(t)$. The output signal of the phase shifter 8 shifts the phase of the output signal $S_1(t)$ from the frequency divider 5 by $\pi/2$ to obtain a second switching carrier $S_2(t)$. The output signal of the divide-by-three frequency divider 5 constitutes a third switching carrier $S_3(t)$. The output signal of the frequency divider 7 constitutes a fourth carrier $S_4(t)$, and the phase shifter 9 shifts the phase of the fourth switching carrier $S_4(t)$ by $\pi/2$ to obtain a fifth switching carrier $S_5(t)$. The output terminals of the frequency divider 5, the phase shifter 8, the frequency divider 4, the frequency divider 7, and the phase shifter 9 are connected to switching carrier input terminals of five product detectors 11, 12, 13, 14 and 15, respectively. The input terminal 10 is connected to signal input terminals of the product detectors 11, 12, 13, 14 and 15 to apply the FM four-channel broadcasting stereophonic composite signal $F(t)$ to the product detectors.

In this embodiment the product detectors are used as the demodulator circuits, but switching circuits may be provided instead.

The output terminals of the product detectors 14 and 15 are respectively connected to input terminals of attenuators 16 and 17, each of which attenuates by the ratio 1:3 the amplitude of signals applied to it. The output terminal of the product detector 12 is connected to an inverter 18, and the output terminal of the attenuator 16 is connected through another inverter 19 to an input terminal of a matrix circuit 20. The output terminals of the product detectors 11 and 13 and of the attenuator 17 are connected directly to respective input terminals of the matrix circuit 20. Further, the input terminal 10 is connected through a low pass filter 21 and a level adjuster 31 to another input terminal of the matrix circuit 20 so that only the main signal $a$ is separated from the signal components of the stereophonic composite signal $F(t)$ by the low pass filter 21 and the amplitude of the main signal $a$ supplied to the matrix circuit 20 through the level adjuster circuit 31 is adjusted to $(2a/\pi)$. The matrix circuit 20 separates left-front, left-rear, right-front, and right-rear sound signals $L_F$, $L_R$, $R_F$ and $R_R$ and directs them, respectively, to four output terminals 22, 23, 24, and 25 of the matrix circuit 20.

The operation of the stereophonic demodulator apparatus of FIG. 2 according to this invention will be described with reference to FIGS. 1A, 1B, and 3A–3E.

The stereophonic composite signal $F(t)$ for FM four-channel broadcasting is supplied to the input terminal 10. The pilot signal component $p \sin (\omega/2)t$ at a frequency of, for example, 19 KHz contained in this stereophonic composite signal $F(t)$ is applied to the input terminal 10 of the phase comparator 1 in the phase locked loop circuit, and this phase comparator 1 controls the oscillating frequency of the variable frequency oscillator 3 to lock the phase locked loop circuit. That is, the oscillating frequency of the variable frequency oscillator 3 is controlled so that the frequency of the signal supplied from the frequency divider 6 to the phase comparator 1 will be 19 KHz. Since the combined division ratio of the frequency dividers 4–6 is (1/12), the oscillating frequency of the variable frequency oscillator 3 must be 228 KHz.

The 228 KHz signal from the oscillator 3 is supplied to the frequency divider 4 to be frequency-divided by 3 and hence the third switching carrier $S_3(t)$ having a frequency of 76 KHz can be obtained at the output terminal of the frequency divider 4. The third switching carrier $S_3(t)$ is further supplied to the frequency divider 5 to be frequency-divided by 2, and hence the first switching carrier $S_1(t)$ having a frequency of 38 KHz can be obtained at the output terminal of the frequency divider 5. This first switching carrier $S_1(t)$ is further supplied to the frequency divider 6 to be frequency-divided by 2, and hence the desired signal having a frequency of 19 KHz can be obtained at the output terminal of the frequency divider 6. This signal of frequency 19 KHz is applied to the phase comparator 1, as mentioned above.

The first switching carrier $S_1(t)$ derived from the frequency divider 5 and the second switching carrier $S_2(t)$ from the phase shifter 8 both have a frequency of 38 KHz but differ in phase by $\pi/2$. When the 228 KHz frequency of the oscillating signal of the variable frequency oscillator 3 is divided by 2 by the frequency divider 7, the fourth switching carrier $S_4(t)$ having a frequency of 114 KHz is produced. Further when this fourth switching carrier $S_4(t)$ is applied to the phase 9, the fifth switching carrier $S_5(t)$ at the same 114 KHz frequency is produced but with a phase difference of $\pi/2$. The frequencies of the first, second, third, fourth, and fifth switching carriers are maintained constant by the operation of the phase locked loop circuit.

These switching carriers $S_1(t)$, $S_2(t)$, $S_3(t)$, $S_4(t)$ and $S_5(t)$ are rectangular waves having a duty cycle of 50%, so that these carriers have only odd-numbered harmonic components and, hence, may be expressed as follows:

$$S_1(t) = (4/\pi) \sin \omega t + (4/3\pi) \sin 3\omega t + \ldots$$

$$S_2(t) = -(4/\pi) \cos \omega t + (4/3\pi) \cos 3\omega t - \ldots$$

$$S_3(t) = (4/\pi) \sin 2\omega t + (4/3\pi) \sin 6\omega t + \ldots$$

$$S_4(t) = (4/\pi) \sin 3\omega t + (4/3\pi) \sin 9\omega t + \ldots$$

$$S_5(t) = (4/\pi) \cos 3\omega t - (4/3\pi) \cos 9\omega t + \ldots \quad (2)$$

Accordingly, the waveforms and phases of these switching carriers $S_1(t)$, $S_2(t)$, $S_3(t)$, $S_4(t)$ and $S_5(t)$ are established as shown in FIGS. 3A to 3E, respectively.

The switching carriers $S_1(t)$ to $S_5(t)$ are supplied to the input terminals of the respective product detectors 11 to 15. Meanwhile, the stereophonic composite signal $F(t)$ from the input terminal 10 is also applied to the product detectors 11 to 15. A useless signal $N(t)$ produced by the effect of the third harmonic component band (114 ± 15 KHz) of the switching carrier of 38 KHz is expressed as follows:

$$N(t) = \sum_{n=1}^{r} a_n \sin(3\omega t + \omega_n t + \theta_n)$$

where $a_n$, $\omega_n$, and $\theta_n$ are respectively amplitude, angular frequency and phase corresponding to noise components, and $\omega_n \leqq 2\pi \times 115$ KHz. This useless signal $N(t)$ is contained in the composite signal $F(t)$.

The stereophonic composite signal $F(t)$ including the useless signal $N(t)$ applied to the product detectors 11 to 15 product-detected by the switching carriers $S_1(t)$ to $S_5(t)$ to obtain product-output signals $E_1$, $E_2$, $E_3$, $E_4$ and $E_5$, respectively, at the output terminals thereof. These product-output signals $E_1$ to $E_5$ are respectively expressed as follows:

$$E_1 = \{F(t) + N(t)\}\cdot S_1(t) = (2/\pi)b + (2/3\pi)\Sigma a_n \cos(\omega_n t + \theta_n)$$

$$E_2 = \{F(t) + N(t)\}\cdot S_2(t) = -(2/\pi)c + (2/3\pi)\Sigma a_n \sin(\omega_n t + \theta_n)$$

$$E_3 = \{F(t) + N(t)\}\cdot S_3(t) = (2/\pi)d \quad (3)$$

$$E_4 = \{F(t) + N(t)\}\cdot S_4(t) = (2/\pi)\Sigma a_n \cos(\omega_n t + \theta_n)$$

$$E_5 = \{F(t) + N(t)\}\cdot S_5(t) = (2/\pi)\Sigma a_n \sin(\omega_n t + \theta_n)$$

The product-output signals $E_1$ and $E_3$ are directly supplied to the matrix circuit 20. The product-output signal $E_2$ is passed through the inverter 18 to be inverted to $E_2' = (2/\pi)c - (2/3\pi)\Sigma a_n \sin(\omega_n t + \theta_n)$, which is then applied to the matrix circuit 20. The product-output signals $E_4$ and $E_5$ are respectively applied to the attenuators 16 and 17 to be attenuated to one-third of their amplitude. The output signal of the attenuator 16 is applied through the inverter 19 to the matrix circuit 20, while the output signal of the attenuator 17 is applied directly to the matrix circuit 20. In mathematical terms, the product-output signals $E_4$ and $E_5$ are respectively attenuated to be $E_4' = -\frac{1}{3}(2/\pi)\Sigma a_n \cos(\omega_n t + \theta_n)$ and $E_5' = \frac{1}{3}(2/\pi)\Sigma a_n \sin(\omega_n t + \theta_n)$, which are then supplied to the matrix circuit 20. The product-output signals $E_1$, $E_2'$, $E_3$, $E_4'$ and $E_5'$ are respectively added together in the matrix circuit 20, so that the useless signal components $(2/3\pi)\Sigma a_n \cos(\omega_n t + \theta_n)$ and $-(2/3\pi)\Sigma a_n \sin(\omega_n t + \theta_n)$ contained in the product-output signals $E_1$ and $E_2'$ are cancelled by the product-output signals $E_4' = -(2/3\pi)\Sigma a_n \cos(\omega_n t + \theta_n)$ and $E_5' = (2/3\pi)\Sigma a_n \sin(\omega_n t + \theta_n)$ with the result that the useless signal component $N(t)$ produced by the effect of the third harmonic component band (114 ± 15 KHz) of the switching carrier can be completely removed.

The stereophonic composite signal $F(t)$ from the input terminal 10 is supplied to the low pass filter 21 and the level adjuster 31. Therefore, among the signal components contained in this stereophonic composite signal $F(t)$, only the main signal $a$ passes through the level adjuster 31 so that the output level of the main signal $a$ is thereby attenuated to $2/\pi$, and this adjusted main signal $(2/\pi)a$ is applied to the matrix circuit 20. As a result, in the matrix circuit 20 the audio signal components $(2/\pi)b$, $(2/\pi)c$ and $(2/\pi)d$ contained in the product-output signals $E_1$, $E_2'$ and $E_3$ and the level-adjusted main signal $(2/\pi)a$ are subjected to operational processing to produce a left-front audio signal $(8/\pi)L_F$ at the output terminal 22 of the matrix circuit 20. Similarly, the other audio signals $L_R$, $R_F$ and $R_R$ can be obtained respectively at the output terminals 23, 24, and 25 of the matrix circuit 20. Consequently, it is possible to produce the audio signals $L_F$, $L_R$, $R_F$ and $R_R$, which are completely free of the useless signal $N(t)$ produced by the effect of the third harmonic component band (114 ± 15 KHz) of the switching carrier, separately at the output terminals 22 to 25 of the matrix circuit 20.

According to the above described embodiment, the fourth and fifth switching carriers $S_4(t)$ and $S_5(t)$ are additionally produced and these carriers $S_4(t)$ are product-detected with the stereophonic composite signal $F(t)$ to obtain the product-output signals $E_4'$ and $E_5'$. When these product-output signals $E_4'$ and $E_5'$ are added in the matrix circuit 20 to the product output signals $E_1$, $E_2'$ and $E_3$ product-detected by the predetermined switching carriers $S_1(t)$, $S_2(t)$ and $S_3(t)$, the useless signal $N(t)$ produced by the effect of the third harmonic component band (114 ± 15 KHz) of the switching carrier contained in these product-output signals $E_1$ and $E_2'$ can be cancelled. Thus, the audio signals $L_F$, $L_R$, $R_F$ and $R_R$ which are completely free from the useless signal $N(t)$ can be separately obtained at the output terminals 22 to 25, respectively, of the matrix circuit 20, and satisfactory FM stereophonic reception can be obtained. In addition, the deterioration of the S/N ratio, the distortion factor, adjacent channel interference characteristics, and the like can be improved without adversely affecting four-channel signal separation characteristics or the like. Hence, listeners can enjoy good FM four-channel reception.

In the above embodiment, the stereophonic demodulator apparatus of this invention can be used for the FM four-channel reception but it is also possible to use the same apparatus for FM two-channel reception. In this case, referring to FIG. 2, a two-channel stereophonic composite signal $F'(t) = (L+R) + (L-R)\sin\omega t + p\sin(\omega/2)t$ (where L is a left audio signal and R is a right audio signal) is supplied to the input terminal 10. With the provision of signal sources of switching carriers of 38 KHz and 114 KHz (corresponding to the frequency dividers 5 and 7), demodulators respectively supplied with the switching carriers from the aforesaid signal sources and the two-channel stereophonic composite signal $F'(t)$ (corresponding to the product detectors 11 and 14), a low pass filter (corresponding to the low pass filter 21) for passing the main signal therethrough, and a mixer circuit (corresponding to the matrix circuit 20), it will be easily understood from the embodiment of FIG. 2 that a useless component caused by its third harmonic component band can be cancelled.

Further, in the present embodiment, the product detectors 11 to 15 are provided as means for demodulating the stereophonic composite signal $F(t)$, and the product-output signals $E_1$ to $E_5$ are produced from these product detectors 11 to 15 as their demodulated output signals. However, as an alternative, switching circuits can be provided as means for demodulating the stereophonic composite signal $F(t)$ to obtain switching output signals.

It will be apparent that many modifications and variations may be effected without departing from the scope of the novel concepts of this invention.

What is claimed is:

1. In a stereophonic demodulator system which demodulates a stereophonic composite signal of the type formed of a main channel including at least two audio information signals, at least one subchannel including a subcarrier of predetermined frequency modulated by said at least two audio information signals, and a pilot subcarrier, and wherein said stereophonic composite signal is susceptible to deterioration due to an accompanying useless signal having a carrier related to said subcarrier of predetermined frequency, apparatus for demodulating said stereophonic composite signal and simultaneously cancelling said useless signal, comprising:

local carrier generating means for generating a first switching carrier whose frequency is equal to said predetermined frequency and a second switching carrier whose frequency is an integral multiple of said predetermined frequency and substantially equal to the frequency of the carrier of said useless signal;

a first demodulating circuit for receiving said stereophonic composite signal and said first switching carrier for demodulating said stereophonic composite signal to produce said one subchannel;

a second demodulating circuit for receiving said stereophonic composite signal and said second switching carrier for demodulating said stereophonic composite signal to produce said useless signal;

separating means for receiving said stereophonic composite signal and separating said main channel therefrom;

and means coupled to said first and second demodulating circuits and said separating means to combine said useless signal with said one subchannel for cancelling a useless signal component produced by said first demodulating circuit and accompanying said one subchannel and for extracting said two audio information signals from said main channel and said one subchannel.

2. Apparatus as set forth in claim 1 wherein said carrier of said useless signal is the third harmonic of said subcarrier of predetermined frequency.

3. Apparatus as set forth in claim 2 wherein said local carrier generating means generates said first switching carrier at a frequency of 38 KHz and said second switching carrier at a frequency of 114 KHz.

4. Apparatus as set forth in claim 2 wherein said local carrier generating means includes a phase locked loop comprising a controllable oscillator for producing a signal that is a harmonic of said pilot signal, divider means for dividing the frequency of said harmonic signal to produce a signal having the same frequency as said pilot subcarrier, phase compare means coupled to said divider means to phase-compare the signal therefrom with said pilot subcarrier, and wherein said divider means further produces said first and second switching carriers.

5. Stereophonic demodulator apparatus for demodulating a stereophonic composite signal having a main channel including four audio information signals, a first subchannel produced by modulating a first subcarrier of a predetermined frequency by said four audio information signals, a second subchannel produced by modulating a $\pi/2$ phase-displaced first subcarrier by said four audio information signals, a third subchannel produced by modulating a second subcarrier of a frequency higher than that of said first subcarrier by said four audio information signals, and a pilot signal having a predetermined frequency, and wherein said stereophonic composite signal is susceptible to deteriorating effects caused by an accompanying useless signal having a carrier substantially equal to the third harmonic of said first subcarrier, said apparatus comprising:

A. a first circuit for producing a first switching carrier having the same frequency as the first subcarrier of said first subchannel;

B. a second circuit for producing a second switching carrier having the same frequency as the first subcarrier of said second subchannel;

C. a third circuit for producing a third switching carrier having the same frequency as the second subcarrier of said third subchannel;

D. fourth and fifth circuits respectively for producing fourth and fifth switching carriers having fundamental frequencies which are the third harmonics of said first subcarrier, and having a phase displacement of $\pi 2$ therebetween;

E. sixth, seventh, eighth, ninth and tenth circuits connected to said first, second, third, fourth, and fifth circuits respectively, and to a source of said stereophonic composite signal for deriving therefrom first, second, third, fourth and fifth demodulated output signals, said first and second demodulated output signals including said first and second subchannels, respectively, accompanied by said useless signal, and said fourth and fifth demodulated output signals each including said useless signal;

F. an eleventh circuit connected to said source of said stereophonic signal for extracting only said main channel of the stereophonic composite signal; and G. a twelfth circuit connected to said sixth, seventh, eighth, ninth and tenth and eleventh circuits for combining said demodulated output signals to cancel said useless signal therefrom and for extracting said four audio information signals.

6. Stereophonic demodulator apparatus as set forth in claim 5, further comprising an oscillator circuit, said first, second, third, fourth, and fifth circuits each comprising a frequency divider to divide the frequency of a signal derived from said oscillator circuit.

7. Stereophonic demodulator apparatus as set forth in claim 6, further comprising:

A. a frequency divider for producing a signal having the same frequency as that of said pilot signal;

B. a phase comparator circuit for phase-comparing a signal from said frequency divider with said pilot signal; and C. means for controlling the oscillating frequency of said oscillator circuit.

* * * * *